US005261543A

United States Patent [19]

Ugarelli

[11] Patent Number: 5,261,543

[45] Date of Patent: Nov. 16, 1993

[54] PLASTIC BOTTLE FOR CONTAINING BOTH UNDER-PRESSURE AND NON UNDER-PRESSURE LIQUIDS

[75] Inventor: Renato Ugarelli, Treviso, Italy

[73] Assignee: Sipa S.p.A., Veneta, Italy

[21] Appl. No.: 738,901

[22] Filed: Aug. 1, 1991

[51] Int. Cl.[5] ..... B65D 1/02; B65D 1/42; B65D 23/10

[52] U.S. Cl. ..... 215/1 C; 220/606; 220/669; 220/675

[58] Field of Search ..... 215/1 C; 220/606, 608, 220/675, 669; D9/551-555

[56] References Cited

U.S. PATENT DOCUMENTS

| | | | |
|---|---|---|---|
| D. 36,097 | 10/1902 | Schilling | D9/551 |
| D. 73,530 | 9/1927 | Lyons | D9/554 |
| D. 152,905 | 3/1949 | Rachins | D9/554 |
| D. 294,464 | 3/1988 | Rogler | D9/551 X |
| 3,727,783 | 4/1973 | Carmichael | 220/608 X |
| 3,935,955 | 2/1976 | Das | 220/606 X |
| 4,249,667 | 2/1981 | Pocock et al. | 215/1 C |
| 4,254,882 | 3/1981 | Yoshino | 220/606 X |
| 4,294,366 | 10/1981 | Chang | 220/606 X |
| 4,446,969 | 5/1984 | Tyler | 220/675 X |
| 4,497,855 | 2/1985 | Agrawal et al. | 215/1 C X |
| 4,785,949 | 11/1988 | Krishnakumar et al. | 215/1 C |
| 4,805,788 | 2/1989 | Akiho | 220/675 X |
| 4,818,575 | 4/1989 | Hirata et al. | 215/1 C X |
| 4,863,046 | 9/1989 | Collette et al. | 220/675 X |
| 4,978,015 | 12/1990 | Walker | 220/608 X |
| 4,997,692 | 3/1991 | Yoshino | 215/1 C X |
| 5,005,716 | 4/1991 | Eberle | 220/606 X |
| 5,024,339 | 6/1991 | Riemer | 220/606 X |
| 5,024,340 | 6/1991 | Alberghini et al. | 220/606 X |
| 5,054,632 | 10/1991 | Alberghini et al. | 220/609 X |
| 5,064,080 | 11/1991 | Young et al. | 220/606 X |

FOREIGN PATENT DOCUMENTS

| | | | |
|---|---|---|---|
| 90987 | 3/1968 | France | 215/1 C |
| 54-30654 | 2/1979 | Japan | 215/1 C |

*Primary Examiner*—Sue A. Weaver

*Attorney, Agent, or Firm*—Wenderoth, Lind & Ponack

[57] ABSTRACT

A substantially cylindrical plastic bottle has a base including a plurality of bulges separated by arcuate ribs. Outer surfaces of the bulges extend vertically down to the bottoms thereof defining a bearing surface of the bottle. The ribs and the bulges extend inwardly to a spherically concave common portion of the base located at the central longitudinal axis of the bottle. The bottle also has a plurality of similar recesses extending therein in a regular pattern at the same height and separated by respective vertical ribs so as to facilitate a gripping and handling of the bottle. The bottle is thus suitable for packaging pressurized and non-pressurized liquids.

7 Claims, 6 Drawing Sheets

PLASTIC BOTTLE FOR CONTAINING BOTH UNDER-PRESSURE AND NON UNDER-PRESSURE LIQUIDS

BACKGROUND OF THE INVENTION

The article of manufacture which is currently used most often in the marketplace for packaging, transporting and distributing liquid, in particular soft carbonated and non-carbonated beverages, is a typically clear bottle-like package. These packages are stacked in multi-tier arrangements in sufficiently robust pre-formed containers or in palletized loads wrapped by means of heat-shrinking plastic film.

Thanks to their widely known characteristics, these plastic bottles are particularly well suited for the above-mentioned applications in a number of respects such as providing good storage conditions for the beverage, providing an immediate identification of the beverage in the bottle, providing excellent impact strength and being lightweight. These characteristics prove quite advantageous during transport and handling operations. Above all, however, these bottles are fully utilizable by consumers and do not impose the necessity of a recovery considering their absolutely modest cost.

This type of bottle also provides wide safety margins against mechanical damage and excellent transportability. However, the currently available bottles have a number of drawbacks that quite frequently lead to practical complications in their use and give rise to high costs in the manufacture thereof.

Plastic bottles can be grouped into two distinct categories, i.e. for carbonated beverages and non-carbonated beverages.

The bottles intended for containing non-carbonated beverages are filled without a gas under pressure, and can be provided with an outer surface defining one or more horizontal grooves of a height of up to several centimeters, which make it more convenient for the user to seize and hold the bottle.

While these grooves also contribute to the mechanical strength of the bottle when it is subject to a vertical load, i.e. a condition that arises when the bottles are full and stacked on each other in multi-tier arrangements, the grooves nonetheless present a serious drawback in that they do not allow the bottles to be filled with carbonated beverages or, at any rate, to be used with a liquid under pressure in excess of 2 or 3 bars. As a matter of fact, such an inner pressure would inevitably stretch the plastic forming the grooves and, ultimately, the bottles would elongate by as much as several millimeters.

When these bottles are then piled upon each other in multitier arrangements, this elongation adds up to an amount which is by no means acceptable considering the strict dimensional constraints imposed by the final bottles.

In order to avoid this drawback, plastic bottles with a plainly smooth or almost smooth surface are used to contain carbonated or, anyway, pressurized beverages.

However, although the problem of the elongation of the bottles due to the internal pressure is eliminated, this measure brings about a new problem. Due to the thin wall-thickness of the plastic bottle and its characteristic of great flexibility under bending load, a normal plastic bottle of the above-described type proves very inconvenient to handle owing to both the fact that it lacks any suitable grip, which prevents small-handed persons, e.g.

children, from being able to seize and handle the bottle with a single hand, and to the fact that, even if the bottle has been properly seized with a single hand, the bottle is bent or deformed accidentally by a simple pressure of the hand while pouring the contents from the bottle. This usually causes the pouring opening of the bottle to bend sidewards and the liquid to be spilled. It is of course possible to increase the wall thickness of the bottle, but this would lead to a considerable increase in costs since such bottles are normally mass-produced in very large quantities, i.e. up to several thousands per hour for each plant.

Apart from these considerations, it is quite apparent that it still is most suitable to use two distinct, different types of bottles for pressurized and non-pressurized beverages. However, this obviously places an additional burden on the manufacturer in terms of both management and organization complexity and manufacturing-related complications.

Furthermore, both of the above-described types of bottles have two further drawbacks.

1) The bottoms of the bottles are formed by an extension of the side cylindrical wall which is divided into a plurality of regular, similar bulges that are arranged regularly in a circle and are oriented downwards.

The external contour of said bulges is inscribed in a geometric half-sphere that closes the bottle in its lower section and that has, as its great circle, the same lower section of the cylinder forming the bottle.

The petaloid formed by said bulges only extends to a certain extent downwards, i.e. down to a certain depth, so that it can form the bearing surface of the bottle. The partial hemisphere-like curvature of the petaloid is to allow the bulges to take on the slightest possible deformation due to the combined, but antagonistic effect of the superimposed load and the internal pressure.

However, the bearing surface of the bottle is in this way reduced to a considerable extent, with the consequence of the obvious, undesired effects on the stability of the bottle itself, particularly when uncapped, which may be brought about by even the slightest impact or push. In order to do away with that particular drawback, special plastic bases having a circular, cover-like shape have been developed, which, when attached externally to the bottom of the bottle, are instrumental in increasing the size of the bearing base of the bottle itself. However, it is quite apparent that this measure brings about the inevitable complication of an additional manufacturing operation and the addition of the related material and manufacturing costs.

2) The second drawback derives from the fact that paper labels, which usually are applied onto the outer surface of the bottle,rub against adjacent bottles or the walls of holding or guiding/conveying means during handling and are thus quite likely to become damaged or torn off. This gives rise to clear inconveniences for the consumer, to a certain loss of image of the contents of the bottles, as well as to the necessity of sorting out the damaged bottles when re-applying the missing or damaged labels.

SUMMARY OF THE INVENTION

It would therefore be quite desirable, and it is an object of the present invention, to provide a single type of plastic bottle which may be mass-produced on an industrial basis, which can advantageously be used to contain both carbonated, i.e. under pressure, and non-carbonated beverages, which will not require a large amount of material for its manufacture, which possesses adequate mechanical characteristics so as not to deform under the combined stress produced by a superimposed load and an inner pressure, which is very convenient to seize and handle, and which finally ensures stability.

BRIEF DESCRIPTION OF THE DRAWINGS

This object is achieved by a bottle which is hereinafter further described by way of non-limiting examples with reference to the accompanying drawings in which.

DETAILED DESCRIPTION OF THE PREFERRED EMBODIMENTS

Referring now to the Figures, the bottle according to the present invention may include the following features:

1) recesses arranged circumferentially of the outer cylindrical surface of the bottle,
2) vertical ribs separating adjacent ones of the recesses from one another,
3) upper and lower cylindrical portions having the greatest radius of the bottle,
4) an outer surface having an intermediate radius of the bottle constituting the area intended for attachment of the label,
5) an appropriate round and fillet between the surfaces of features 3 and 4,
6) a label,
7) lower bearing bulges,
8*a*) outer surfaces of the bulges,
8*b*) concave walls of the bulges,
9) arcuate, mechanically strengthening ribs between said bulges,
10) point of attachment of the outer ends of said ribs,
11) common element for the internal ends of the ribs 9,
12) circumferential groove in the outer surface,
13) side parallel flanks of the ribs 9,
15, 16) arcuate interruption surfaces for the groove 12.

To make it easier to understand the above elements and features, which at any rate are nearly self-evident from viewing the Figures, the present invention can be considered as being substantially in the form of a general cylindrical surface that extends, except for some portions constituted by a plurality of arcuate ribs 9, fully down to the bearing surface of the bottle.

Figure 2A:
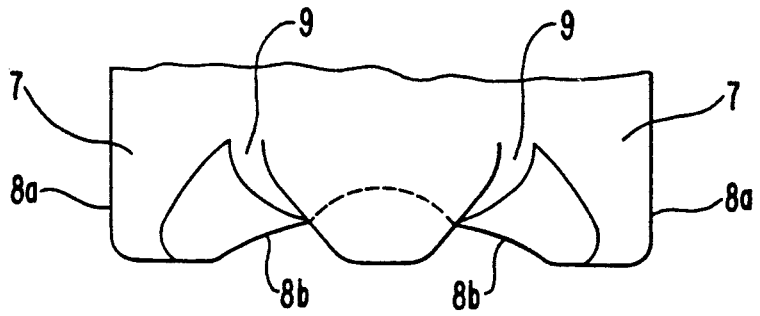
FIGS. 2A, 2B and 2C are vertical elevation, plan and sectional views, respectively, of the bottom portion of the bottle according to the invention, FIG. 2C being taken through a rib along line 2C—2C in FIG. 2B and FIGS. 3, 4, 5 and 6 are perspective views of other embodiments of the bottle according to the present invention.
Figure 2B:
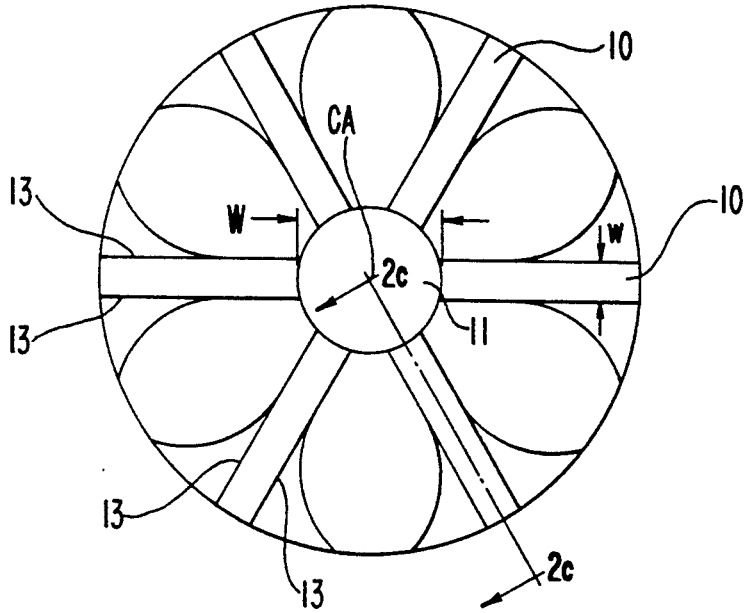
Figure 2C:
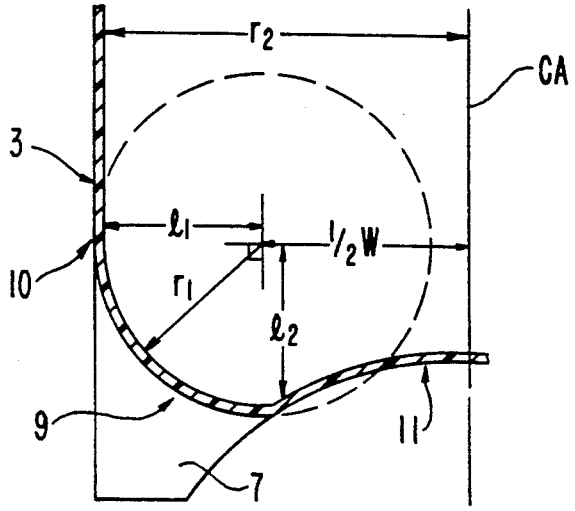
Figure 3:
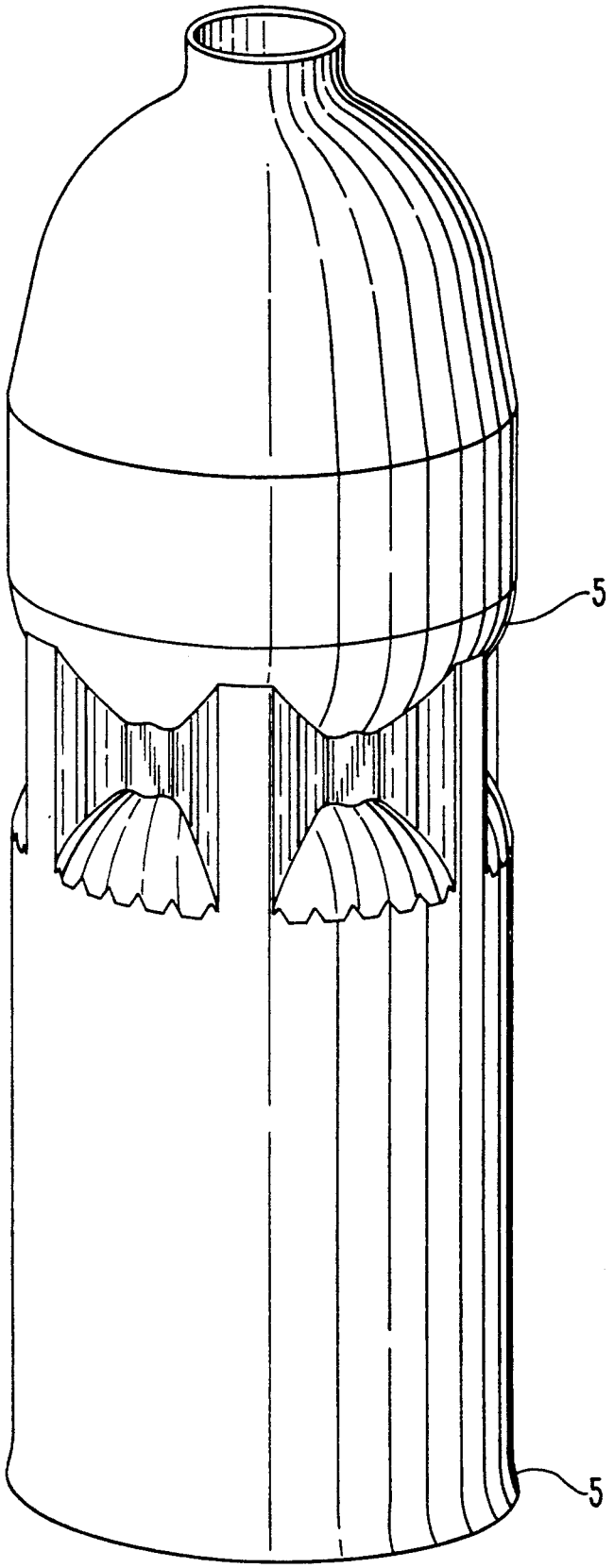
Figure 4:
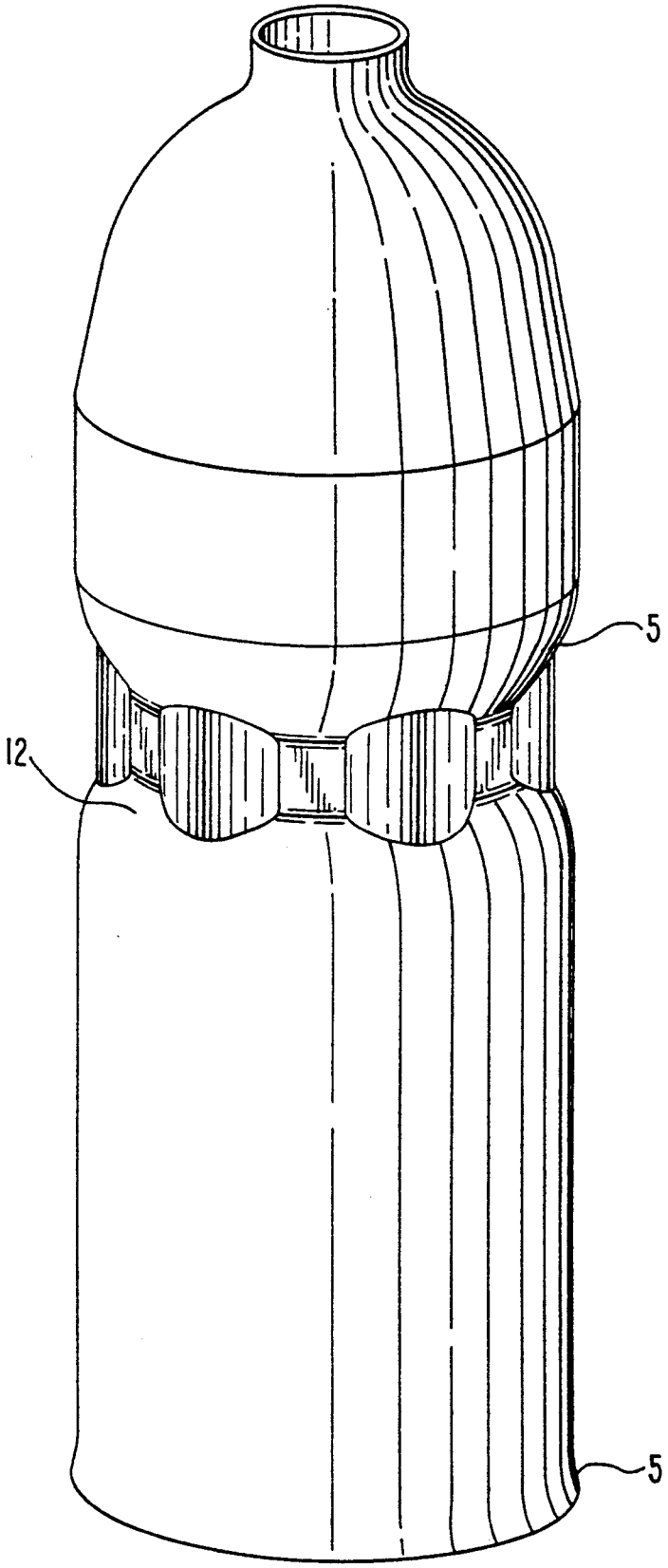
Figure 5:
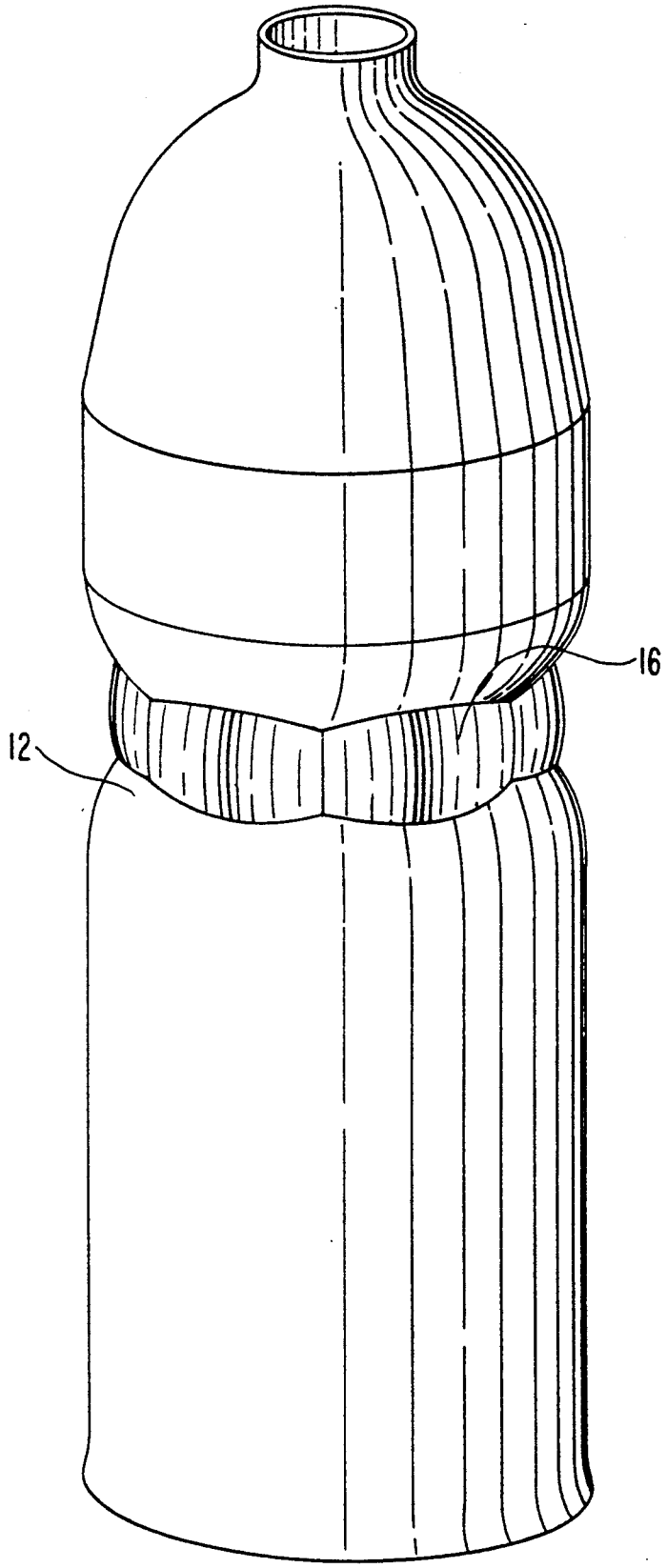
Figure 6:
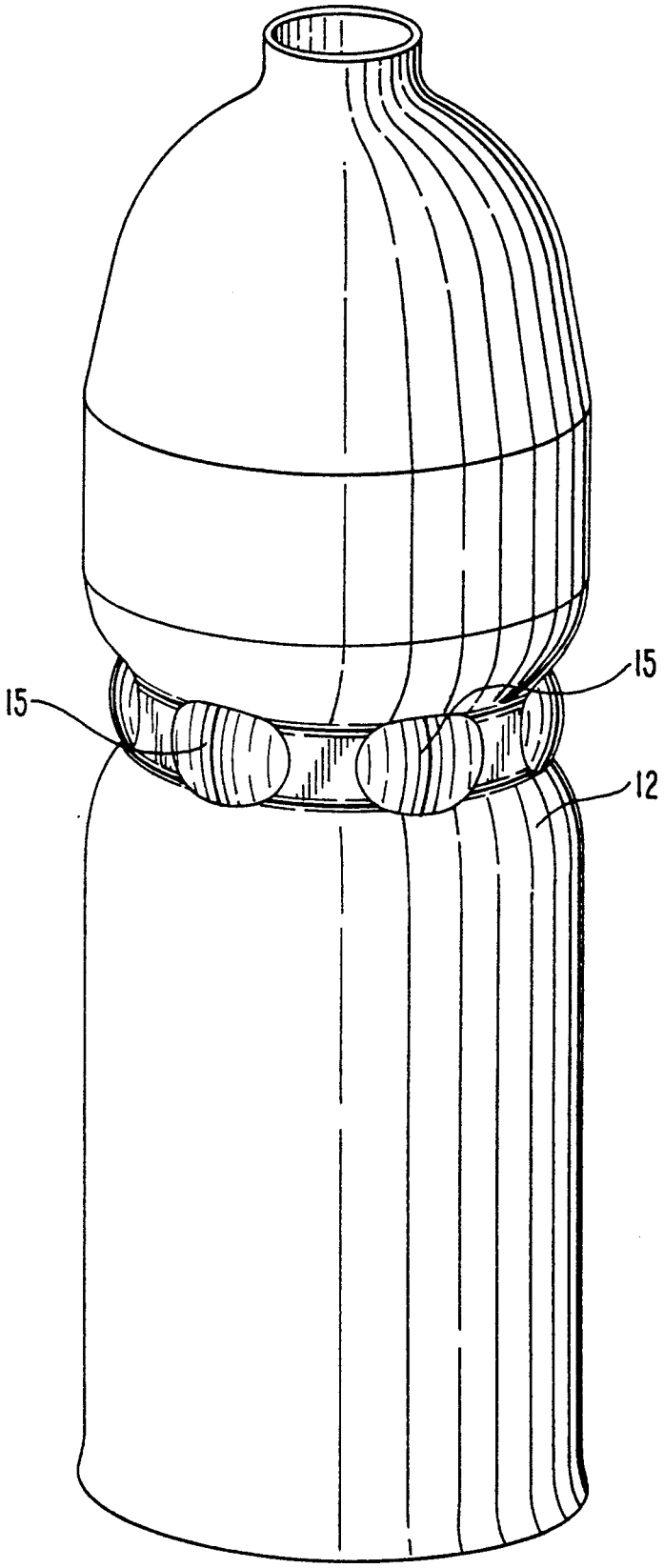

The arcuate ribs 9, each in the form of a quarter circle ($l_1=l_2$ as shown in FIG. 2C), are injection or blow molded integrally with the same material forming the remainder of the bottle and have outer ends 10 (FIG. 2C) at which the ribs 9 are tangential to the lower cylindrical portion, i.e. portion 3, of the bottle located above the bearing of the bottle surface, and which portion has a slightly smaller radius than that of the bearing surface itself.

An inner end of each one of the ribs 9 terminates at and is contiguous with a common element 11, which is concave in the form of a small portion of a sphere and relieves the mutual, opposing stresses induced by the ribs 9.

The longitudinal axis of each rib 9 thus extends from the respective end 10 thereof to the common element 11. The transverse cross section of the rib as taken at each point along its longitudinal axis is flat as can be made out from FIG. 2C. The width "w" of each rib 9 is constant as seen best in FIG. 2B. Further, the radius of curvature $r_1$ of each rib 9 is equal to the radius of the bottle $r_2$ minus one-half of the width "W" of the common element 11 as taken perpendicular to the longitudinally central axis CA of the bottle.

Bulges 7 extend between the ribs 9. The inner pressure is exerted on the bulges 7 which are in turn retained by the ribs 9.

Figure 1:
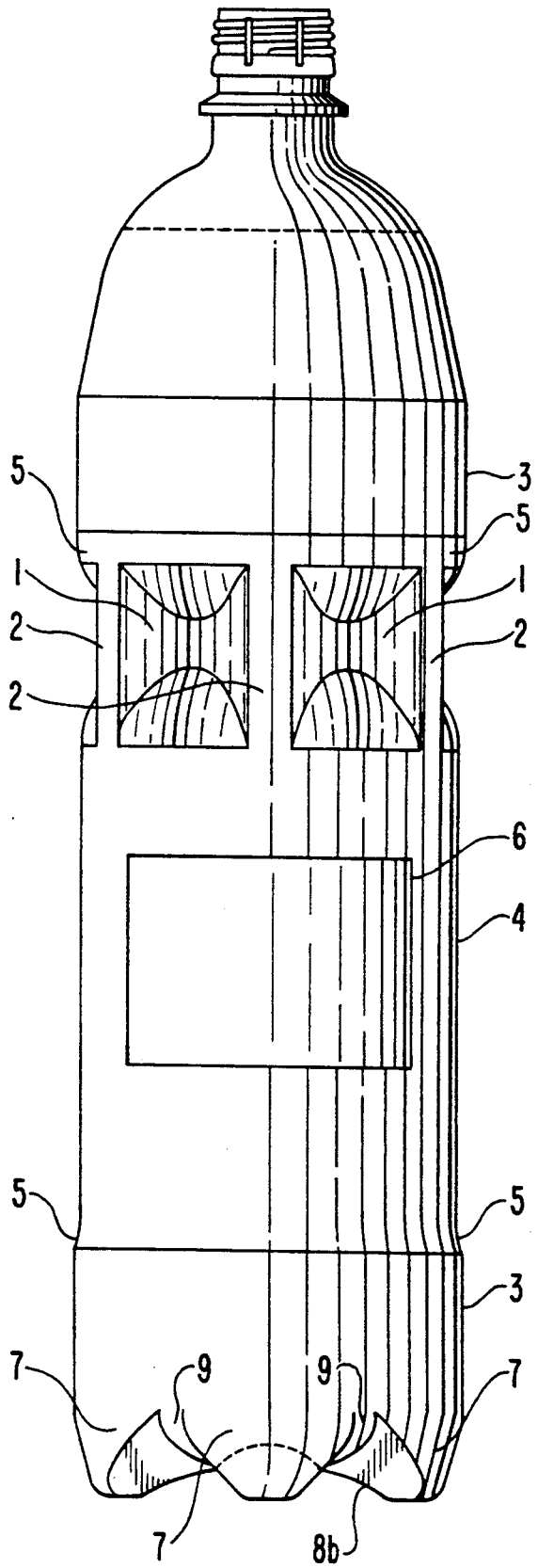
FIG. 1 is an elevational view of a bottle according to the invention.

The ribs therefore constitute a stiffening means capping the bottom of the bottle. Because of their overall half-spherical extent and arrangement, the ribs possess the utmost strength. Consequently, the slightest possible distortion is prevented. Therefore, the outer surfaces 8*a* of the bulges 7 extend fully down to the bearing surface. The bulges 7 also have concave walls 8*b* (FIGS. 1 and 2A) extending between the bottoms thereof and the common element 11. In this way it is possible to provide an adequately large bearing surface without any risk of appreciable distortion, any increase in the amount of material necessary for providing a sufficient wall thickness, or any addition of separately applied bases or socles.

In this way, a configuration is achieved which is the exact opposite, i.e. "negative" of the known configuration. The characteristics of mechanical strength hitherto ensured by the half-spherical profile of the bulges are, according to this invention, accomplished with far better results by the plurality of radially arranged ribs which relieve the stresses through the common element 11.

In order to ensure the effectiveness of said ribs, the ribs preferably are in the shape of arcuate strips having a finite, constant width, with the flanks 13 extending parallel. Ideally, the ribs are in the form of a rectangle of a given width and length that is bent but not twisted.

Mechanical compressive, flexural and elongation strength characteristics, and the ability of the bottle to be conveniently seized and handled, are provided by a plurality of recesses 1 that are arranged in a regular pattern at the same level in the outer surface 3 of the bottle.

Said recesses are defined by a groove 12 extending horizontally in, i.e. circumferentially of the outer surface, and suitable structural elements extending vertically across the groove 12.

Preferably, the recesses are separated by vertical ribs 2 connecting an upper cylindrical portion 3 with an intermediate cylindrical portion 4 of the bottle.

It should thus be readily apparent that the above-described embodiment exhibits an excellent mechanical performance.

And it is just as apparent that the embodiments shown in FIGS. 3 through 6 are only a few of the many possible variants according to this invention. These embodiments offer various degrees of seizability and styling characteristics.

The protection of the label 6 will be ensured by the different sized cylindrical portions of the bottle, i.e. the larger diameter upper and lower cylindrical portions 3 of the bottle, and the smaller diameter intermediate cylindrical portion 4 onto which the label is applied, as is well-known in the state of the art. The label will in this way be unable to come into contact with either walls or adjacent bottles of the same type.

The improvement resides in the junctions between the two different sized cylindrical portions of the bottle being in the form of a round 5 and a fillet 5, of which the upper round 5 forms an upper end of the aforementioned groove 12.

It will be appreciated that what has been described above and shown with reference to the accompanying drawings is only exemplary of the present invention. Therefore, the present invention may encompass various modifications without departing from the scope of the claims.

I claim:

1. A plastic bottle suitable for packaging both pressurized and non-pressurized liquids, said bottle comprising: a generally cylindrical body, and a base at the bottom of said body and unitary therewith; said body having a circumferential groove therein and vertical ribs running across said groove so as to define a plurality of recesses located about the circumference of said body which facilitate a gripping and handling of the bottle, and said body having a lower cylindrical portion below said circumferential groove; said base having a plurality of arcuate ribs having respective outer ends terminating at said lower cylindrical portion of said body of the bottle, said arcuate ribs extending longitudinally from the respective outer ends thereof downwardly and inwardly toward the central longitudinal axis of the bottle, a plurality of bulging portions extending from said lower cylindrical portion of said body of the bottle and collectively defining a bearing surface at respective bottoms thereof, and a common portion at the center thereof that is spherically concave; each of said ribs having inner ends terminating at said spherically concave common portion of the base; each of said ribs extending between adjacent ones of said bulging portions; each of said arcuate ribs having a central longitudinal axis in the shape of a quarter of a circle, and a radius of curvature equal to the radius of the lower cylindrical portion of the bottle minus one-half the width of the common portion of the bottle as taken perpendicular to the central longitudinal axis of the bottle; and each of said bulging portions having inner portions terminating at said spherically concave common portion.

2. A plastic bottle suitable for packaging both pressurized and non-pressurized liquids, said bottle comprising: a generally cylindrical body, and a base at the bottom of said body and unitary therewith; said body having a circumferential groove therein and vertical ribs running across said groove so as to define a plurality of recesses located about the circumference of said body which facilitate a gripping and handling of the bottle, and said body having a lower cylindrical portion below said circumferential groove; said base having a plurality of arcuate ribs having respective outer ends terminating at said lower cylindrical portion of said body of the bottle, the outer ends of said ribs intersecting the lower cylindrical portion of said bottle tangentially, said arcuate ribs extending from the respective outer ends thereof downwardly and inwardly toward the central longitudinal axis of the bottle, a plurality of bulging portions extending from said lower cylindrical portion of said body of the bottle and collectively defining a bearing surface at respective bottoms thereof, and a common portion at the center thereof that is spherically concave; each of said ribs having inner ends terminating at said spherically concave common portion of the base; each of said ribs extending between adjacent ones of said bulging portions; and each of said bulging portions having inner portions terminating at said spherically concave common portion.

3. A plastic bottle as claimed in claim 1, wherein the outer ends of said ribs intersect the lower cylindrical portion of said bottle tangentially.

4. A plastic bottle as claimed in any one of claims 1 and 2, wherein each of said ribs has a constant width and a flat transverse cross section over the length thereof.

5. A plastic bottle as claimed in any one of claims 1 and 2, wherein said bulging portions have outer surfaces which are substantially vertical extensions of said lower cylindrical portion of the body down to the bottom thereof so as to lie in a common cylinder with said lower cylindrical portion.

6. A plastic bottle as claimed in any one of claims 1 and 2, wherein said bulging portions have concave walls extending between the bottoms thereof and said spherically concave common portion of the base.

7. A plastic bottle suitable for packaging both pressurized and non-pressurized liquids, said bottle comprising: a generally cylindrical body having an upper cylindrical portion, a lower cylindrical portion, and an intermediate cylindrical portion interposed between said upper and said lower cylindrical portions and having a diameter smaller than those of each of said upper and said lower cylindrical portions, and a base at the bottom of said body and unitary therewith; said body having a circumferential groove located within said intermediate cylindrical portion and vertical ribs running across said groove so as to define a plurality of recesses located about the circumference of said body which facilitate a gripping and handling of the bottle, and said lower cylindrical portion being located below said circumferential groove, said vertical ribs being convex as taken in the circumferential direction of the bottle and also being convex as taken in the longitudinal direction of the bottle, said recesses having identical shapes and being spaced in a regular pattern at the same level about the circumference of the bottle, and said body having a circumferentially extending round defining an upper end of both said intermediate cylindrical portion and said circumferential groove, and a circumferentially extending fillet defining a lower end of said intermediate cylindrical portion, said vertical ribs extending from said round; said base having a plurality of arcuate ribs having respective outer ends terminating at said lower cylindrical portion of said body of the bottle, said arcuate ribs extending from the respective outer ends thereof downwardly and inwardly toward the central longitudinal axis of the bottle, a plurality of bulging portions extending from said lower cylindrical portion of said body of the bottle and collectively defining a bearing surface at respective bottoms thereof, and a common portion at the center thereof that is spherically concave; each of said ribs having inner ends terminating at said spherically concave common portion of the base; each of said ribs extending between adjacent ones of said bulging portions; and each of said bulging portions having inner portions terminating at said spherically concave common portion.

* * * * *